US008955472B2

(12) United States Patent
Shintani et al.

(10) Patent No.: US 8,955,472 B2
(45) Date of Patent: Feb. 17, 2015

(54) WORK VEHICLE AND CONTROL METHOD FOR WORK VEHICLE

(75) Inventors: Satoru Shintani, Hirakata (JP); Shigeru Yamamoto, Hirakata (JP); Kazuyuki Suzuki, Hirakata (JP); Takeshi Takaura, Minoo (JP); Tomohiro Nakagawa, Hirakata (JP)

(73) Assignee: Komatsu Ltd., Tokyo (JP)

( * ) Notice: Subject to any disclaimer, the term of this patent is extended or adjusted under 35 U.S.C. 154(b) by 206 days.

(21) Appl. No.: 12/595,285

(22) PCT Filed: May 19, 2008

(86) PCT No.: PCT/JP2008/059159

§ 371 (c)(1),
(2), (4) Date: Oct. 9, 2009

(87) PCT Pub. No.: WO2009/001633

PCT Pub. Date: Dec. 31, 2008

(65) Prior Publication Data

US 2010/0107996 A1 May 6, 2010

(30) Foreign Application Priority Data

Jun. 25, 2007 (JP) ..... 2007-166381

(51) Int. Cl.
*F01P 7/02* (2006.01)
*E02F 9/20* (2006.01)
(Continued)

(52) U.S. Cl.
CPC ..... *E02F 9/2025* (2013.01); *F01P 7/08* (2013.01); *F02D 29/04* (2013.01); *F01P 7/044* (2013.01); *F02D 29/02* (2013.01)
USPC ..... 123/41.12

(58) Field of Classification Search
USPC ..... 123/196 AB, 41.31, 41.12; 184/104.1, 184/6.22, 27.2, 29; 417/32, 213; 60/328, 60/493, 405, 456, 484, 431, 429; 180/53.4, 53.2, 337, 406, 324
See application file for complete search history.

(56) References Cited

U.S. PATENT DOCUMENTS 4,062,329 A * 12/1977 Rio ..... 123/41.12
6,192,860 B1 * 2/2001 Hatlen ..... 123/352
(Continued)

FOREIGN PATENT DOCUMENTS

JP 2000-110560 A 4/2000
JP 2001-182535 A 7/2001
(Continued)

OTHER PUBLICATIONS

Extended European Search Report of corresponding EP Application No. 08 75 2955.8 dated Apr. 27, 2011.

*Primary Examiner* — Marguerite McMahon
*Assistant Examiner* — James Kim
(74) *Attorney, Agent, or Firm* — Global IP Counselors, LLP

(57) ABSTRACT

A work vehicle is provided with an engine, a traveling device driven by driving force from the engine to cause the work vehicle to travel, a first hydraulic pump driven by the driving force from the engine to discharge hydraulic oil, and a cooling device having a cooling fan driven by the hydraulic oil supplied by the first hydraulic pump to cool the engine, and a control unit. The control unit performs a normal cooling control in which an upper limit fan speed is determined based on an engine speed, and a cooling suppression control in which the upper limit fan speed determined based on the engine speed is suppressed to be less than the upper limit fan speed during the normal cooling control when a predetermined operation required to increase the engine speed is performed.

16 Claims, 10 Drawing Sheets

(51) Int. Cl.

| | |
|---|---|
| ***F01P 7/08*** | (2006.01) |
| ***F02D 29/04*** | (2006.01) |
| *F01P 7/04* | (2006.01) |
| *F02D 29/02* | (2006.01) |

(56) References Cited

U.S. PATENT DOCUMENTS

| | | | | |
|---|---|---|---|---|
| 6,349,882 | B1 * | 2/2002 | Kita et al. | 236/34 |
| 6,457,564 | B1 * | 10/2002 | Damm et al. | 184/6.5 |
| 6,899,074 | B1 * | 5/2005 | Carlsson | 123/196 AB |
| 7,373,239 | B2 * | 5/2008 | Kamado et al. | 701/103 |
| 7,415,945 | B2 * | 8/2008 | Tuttle | 123/41.11 |
| 7,841,307 | B2 * | 11/2010 | Itoga et al. | 123/41.12 |
| 7,841,837 | B2 * | 11/2010 | Chen | 417/14 |
| 7,863,839 | B2 * | 1/2011 | Schuricht et al. | 318/268 |
| 2002/0128118 | A1 * | 9/2002 | Milender et al. | 477/143 |
| 2004/0141849 | A1 * | 7/2004 | Deneir et al. | 417/32 |
| 2006/0272496 | A1 * | 12/2006 | Ohashi | 91/472 |
| 2007/0207890 | A1 * | 9/2007 | Penksik | 475/275 |
| 2009/0145376 | A1 | 6/2009 | Okuda et al. | |

FOREIGN PATENT DOCUMENTS

| | | | |
|---|---|---|---|
| JP | 2006-241984 | A | 9/2006 |
| JP | 2007-127036 | A | 5/2007 |
| WO | WO 2005/021946 | A1 | 3/2005 |
| WO | WO 2007/026627 | A1 | 3/2007 |

* cited by examiner

WORK VEHICLE AND CONTROL METHOD FOR WORK VEHICLE

CROSS-REFERENCE TO RELATED APPLICATIONS

This national phase application claims priority to Japanese Patent Application No. 2007-166381, filed on Jun. 25, 2007. The entire disclosure of Japanese Patent Application No. 2007-166381 is hereby incorporated herein by reference.

TECHNICAL FIELD

The present invention relates to a work vehicle and a method for controlling the work vehicle.

RELATED ART

Background Art

Work vehicles such as bulldozers are provided with a cooling device for cooling an engine, and the cooling device is driven by oil pressure supplied from a hydraulic pump. The output of the cooling device is controlled based on engine speed, cooling water temperature, and other factors, as is disclosed in Japanese Laid-Open Patent Application No. 2001-182535, for example.

However, in a work vehicle such as the one mentioned above, some of the horsepower of the engine is used in order to drive the cooling device. Therefore, when the work vehicle performs an action requiring an increase in engine speed, the acceleration performance of the engine speed may decrease.

SUMMARY OF THE INVENTION

An object of the present invention is to provide a work vehicle and a method for controlling the work vehicle whereby the decrease in the acceleration performance of the engine speed can be minimized.

A work vehicle of a first aspect of the present invention includes an engine, a traveling device configured and arranged to be driven by driving force from the engine to cause the vehicle to travel, a first hydraulic pump configured and arranged to be driven by driving force from the engine to discharge hydraulic oil, a cooling device having a cooling fan configured and arranged to be driven by hydraulic oil supplied by the first hydraulic pump to cool the engine, and a control unit. The control unit is configured to perform a normal cooling control in which an upper limit fan speed is determined based on an engine speed, and to perform a cooling suppression control in which the upper limit fan speed determined based on the engine speed is suppressed to be less than the upper limit fan speed during the normal cooling control. The control unit is configured to perform the cooling suppression control when a predetermined operation required to increase the engine speed is performed.

According to the work vehicle, the cooling suppression control for suppressing operation of the cooling device is performed when the predetermined operation deemed necessary to increase the engine speed is performed. As a result, it is possible to promote an increase in engine speed. Also, according to the work vehicle, the upper limit fan speed during execution of the cooling suppression control is suppressed to the value lower than an upper limit fan speed during execution of the normal cooling control. It is therefore possible to decrease horsepower of the engine used for driving the cooling device and to promote an increase in engine speed.

In a work vehicle of a second aspect of the present invention, the control unit is configured to end the cooling suppression control when at least one of a condition in which the engine speed reaches a predetermined speed, and a condition in which a predetermined time elapses from a predetermined reference timing set on or after a start timing of the cooling suppression control is satisfied.

According to the work vehicle, the cooling suppression control ends when at least one condition of the engine speed reaching a predetermined speed, and a predetermined time elapsing from a predetermined reference timing set on or after the start timing of the cooling suppression control is satisfied. When the engine speed reaches a predetermined speed, the cooling performance of the engine is returned to its original level by the cooling device as a result of the cooling suppression control being made to end. This is because the cooling suppression control is no longer necessary from thereon. Further, the cooling suppression control is made to end when a predetermined time elapses from the reference timing even when the engine speed does not reach the predetermined speed. It is therefore possible to prevent a situation where suppression of operation of the cooling device continues for a long period of time and it is possible to suppress excessive falls in engine cooling performance.

In a work vehicle of a third aspect of the present invention, with the work vehicle of the first aspect, the traveling device has a transmission configured and arranged to shift between neutral, forward and reverse modes. The control unit is configured to perform the cooling suppression control when the transmission is shifted from the neutral mode to the forward or reverse mode.

According to the work vehicle, the cooling suppression control is performed when the transmission is shifted from neutral to forward or reverse. It is therefore possible to increase acceleration when the work vehicle goes from stationary to forward or into reverse.

In a work vehicle of a fourth aspect of the present invention, with the work vehicle of the first aspect, the traveling device has a transmission configured and arranged to shift between a plurality of gear positions. The control unit is configured to calculate drive force of the work vehicle and to perform the cooling suppression control when the drive force is constant and the transmission shifts down.

According to the work vehicle, the cooling suppression control is performed when the transmission shifts down. An acceleration directly after shifting down can therefore be improved.

With the work vehicle of a fifth aspect of the present invention, in the work vehicle of a second aspect, the traveling device has a transmission configured and arranged to shift between neutral, forward and reverse modes. The transmission has a clutch driven by hydraulic oil. The control unit is configured to perform the cooling suppression control when the transmission is shifted from the neutral mode to the forward or reverse mode. The reference timing is then a modulation ending timing of the clutch.

According to the work vehicle, the cooling suppression control is ended when a predetermined time elapses from the end of modulation of the clutch. It is therefore possible to sufficiently ensure the time required to increase the engine speed from completion of changing of the clutch. It is also possible to prevent an excessively continuing situation where operation of the cooling device is suppressed.

In a work vehicle of a sixth aspect of the present invention, with the work vehicle of the first aspect, the traveling device has a torque converter with a lock-up clutch. The control unit is configured to perform the cooling suppression control when the lock-up clutch changes from on to off.

According to the work vehicle, the cooling suppression control is performed when the lock-up clutch goes from on to off. It is therefore possible to increase an acceleration of the work vehicle while shifting speeds by switching over the lock-up clutch.

With work vehicle of a seventh aspect of the present invention, in the first aspect of the work vehicle, the control unit is configured to perform the cooling suppression control when an instruction value of the engine speed changes from a predetermined first speed or less to a value greater than or equal to a second speed faster than the first speed and the engine speed is smaller than the second speed.

According to the work vehicle, the cooling suppression control is performed when the engine speed does not increase to the second speed regardless of whether an instructed value of the engine speed is changed to a value greater than or equal to the second speed faster than the first speed from less than or equal to the predetermined first speed. As a result, it is possible for the engine speed to rise rapidly to the instructed value.

In a work vehicle of a eighth aspect of the present invention, with the work vehicle of the first aspect further includes a decelerator device. The decelerator device is configured and arranged to reduce an instruction value of the engine speed from a normal value when the decelerator device is changed to on state, and to increase the instruction value of the engine speed back to the normal value when the decelerator device is changed to off state. The control unit is configured to perform the cooling suppression control when the decelerator device changes from on to off and the engine speed is slower than a speed corresponding to the normal value.

According to the work vehicle, the cooling suppression control is performed when the engine speed does not increase up to a speed corresponding to the normal value regardless of the decelerator device changing from on to off. As a result, it is possible for the engine speed to rise rapidly to the normal value.

In a work vehicle of a ninth aspect of the present invention, with the work vehicle of the second aspect, the traveling device has a torque converter with a lock-up clutch. The control unit is configured to perform the cooling suppression control when the lock-up clutch changes from on to off. The reference timing is the start timing of the cooling suppression control.

According to the work vehicle, the cooling suppression control is ended when a predetermined time elapses from the start of the cooling suppression control. It is therefore possible to sufficiently ensure the time required to increase the engine speed. It is also possible to prevent a situation where operation of the cooling device is suppressed from continuing excessively.

The work vehicle of a tenth aspect of the present invention, in the work vehicle of the first aspect, further includes a second hydraulic pump configured and arranged to be driven by driving force from the engine to discharge hydraulic oil, and a work implement configured and arranged to be driven by hydraulic oil supplied by the second hydraulic pump. The traveling device has a transmission configured and arranged to switch gears by changing over engagement of the clutch using hydraulic oil. The cooling device has a hydraulic motor configured and arranged to be driven by hydraulic oil to rotate the cooling fan, and the cooling device is configured and arranged to cool cooling water of the engine, hydraulic oil supplied to the work implement and the hydraulic motor, and hydraulic oil supplied to the clutch. The control unit is configured to prohibit the cooling suppression control when at least one of a temperature of the engine cooling water, a temperature of the hydraulic oil supplied to the work implement and the hydraulic motor, and a temperature of the hydraulic oil supplied to the clutch is equal to or greater than a predetermined overheat warning temperature.

According to the work vehicle, the cooling suppression control is not performed when at least one of each of the temperatures of the engine cooling water that is a cooling object of the cooling device, hydraulic oil supplied to the work implement and hydraulic motor, and hydraulic oil supplied to the clutch is a predetermined overheat warning temperature or more. As a result, it is possible to suppress excessive rises in each of the temperatures of the cooling water of the engine, the hydraulic oil supplied to the work implement and the hydraulic motor, and the hydraulic oil supplied to the clutch.

The work vehicle of an eleventh aspect of the present invention, in the work vehicle of the first aspect, further includes a decelerator device. The decelerator device is configured to reduce an instruction value of the engine speed from a normal value when the decelerator device is changed to on state, and to increase the instruction value of the engine speed back to the normal value when the decelerator device is changed to off state. The traveling device has a transmission and a torque converter with a lock-up clutch. The transmission configured and arranged to shift between neutral, forward and reverse modes and between a plurality of gear positions. The control unit is configured to perform the cooling suppression control when one of a first mode, a second mode, a third mode, or a fourth mode. The first mode is a case of advancing from a standstill or shifting between forward and reverse modes. The second mode is a case of switching the deceleration device from on to off. The third mode is a case of switching the lock-up clutch from on to off. The fourth mode is a case of shifting the transmission down when drive force of the work vehicle is constant.

According to the work vehicle, the cooling suppression control to suppress operation of the cooling device is performed when one of the first mode to the fourth mode deemed necessary to increase the engine speed is performed. It is therefore possible to promote an increase in engine speed.

In a work vehicle of a twelfth aspect of the present invention, with the work vehicle of the second aspect, the traveling device has a transmission configured and arranged to shift between a plurality of gear positions. The transmission has a clutch driven by hydraulic oil. The control unit is configured to calculate drive force of the work vehicle and to perform the cooling suppression control when the drive force is constant and the transmission shifts down. The reference timing is a modulation ending timing of the clutch.

According to the work vehicle, the cooling suppression control is performed when the transmission shifts down. An acceleration directly after shifting down can therefore be improved. It is therefore possible to prevent a situation where suppression of operation of the cooling device continues for a long period of time and it is possible to suppress excessive falls in engine cooling performance.

With work vehicle of a thirteenth aspect of the present invention, in the second aspect of the work vehicle, the control unit is configured to perform the cooling suppression control when an instruction value of the engine speed changes from a predetermined first speed or less to a value greater than or equal to a second speed faster than the first speed and the engine speed is smaller than the second speed. The reference timing is the starting timing of the cooling suppression control.

According to the work vehicle, the cooling suppression control is performed when the engine speed does not increase to the second speed regardless of whether an instructed value of the engine speed is changed to a value greater than or equal to the second speed faster than the first speed from less than or equal to the predetermined first speed. As a result, it is possible for the engine speed to rise rapidly to the instructed value. It is also possible to prevent a situation where suppression of operation of the cooling device continues for a long period of time and it is possible to suppress excessive falls in engine cooling performance.

A control method for a work vehicle of a fourteenth aspect of the present invention is a control method for the work vehicle provided with an engine, a traveling device driven by driving force from the engine to cause the work vehicle to travel, a first hydraulic pump driven by driving force from the engine to discharge hydraulic oil, and a cooling device driven by hydraulic oil supplied by the first hydraulic pump to cool the engine. The control method includes determining whether a predetermined operation requiring an increase in engine speed is being performed or not, performing a normal cooling control to determine an upper limit fan speed of the cooling fan based on an engine speed when the predetermined operation is not being performed, and performing a cooling suppression control to suppress the upper limit fan speed determined based on the engine speed to be less than the upper limit fan speed during the normal cooling control when the predetermined operation is being performed.

According to the control method for the work vehicle, the cooling suppression control for suppressing operation of the cooling device is performed when the predetermined operation required to increase the engine speed. As a result, it is possible to promote an increase in engine speed.

DETAILED DESCRIPTION OF THE PREFERRED EMBODIMENTS

Overall Configuration

Figure 1:
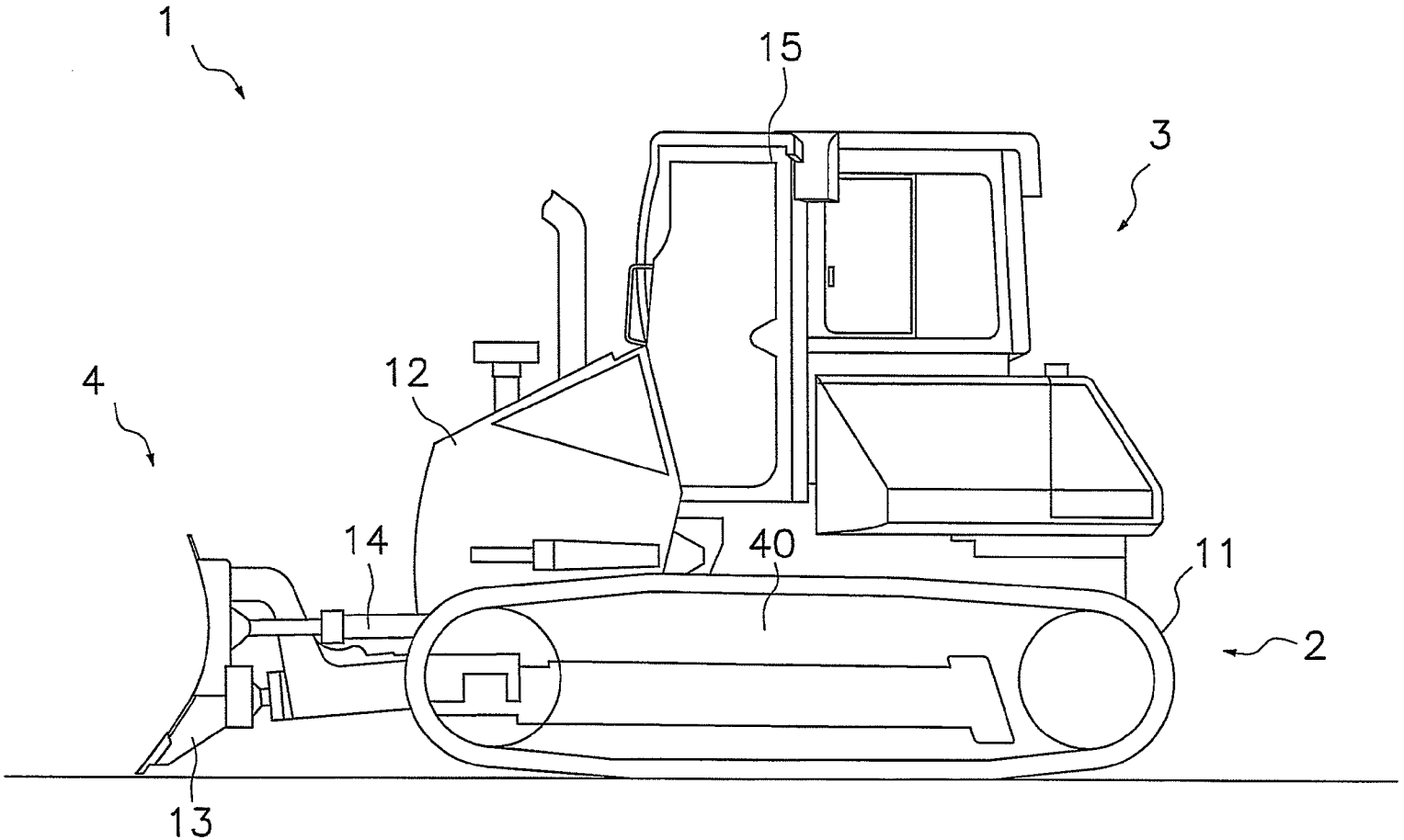
FIG. 1 is a side view of a work vehicle.

A side view showing the outside of a work vehicle 1 of an embodiment of the present invention is shown in FIG. 1. The work vehicle 1 is a bulldozer and is equipped with a pair of left and right traveling units 2, a vehicle body 3, and work implement 4.

The traveling unit 2 has a crawler belt 11. The work vehicle 1 travels as a result of the crawler belts 11 being driven.

The vehicle body 3 is mounted across the pair of left and right traveling units 2. An engine compartment 12 is then provided at a front part of the vehicle body 3. An engine and a cooling device (described later) are housed in the engine compartment 12. An operator's cab 15 is provided to the rear of the engine compartment 12.

Work implement 4 is provided to the front of the engine compartment 12 and has an earth-moving blade 13 moveable in a vertical direction, and hydraulic cylinders 14 that actuate the blade 13.

Figure 2:
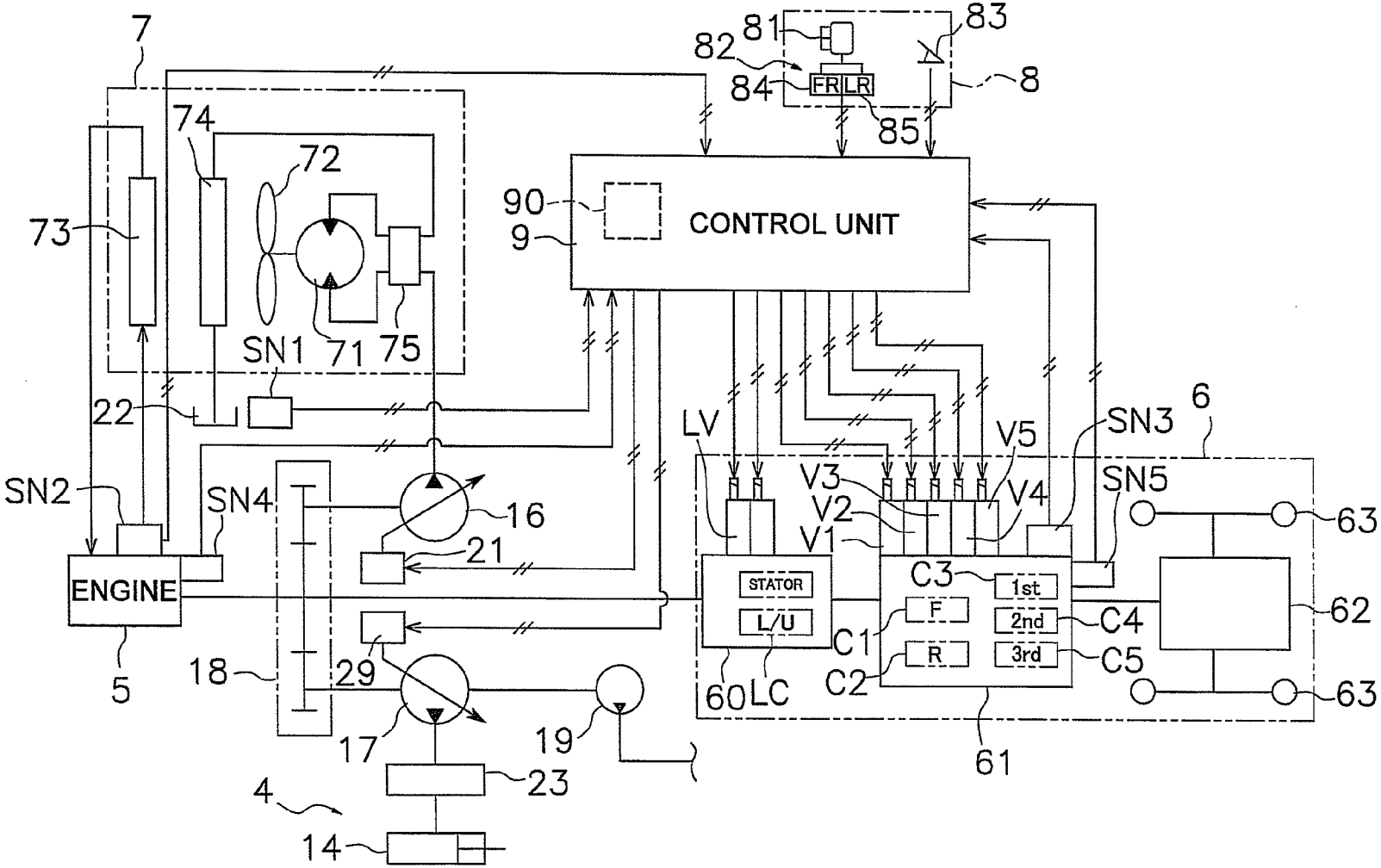
FIG. 2 is a block diagram showing the inside of a work vehicle.

Next, a block diagram showing the inside of the work vehicle 1 is shown in FIG. 2. The work vehicle 1 has an engine 5, a traveling device 6, a traveling device hydraulic pump 19, a first hydraulic pump 16, a cooling device 7, a second hydraulic pump 17, an operation device 8, various sensors SN1 to SN5, and a control unit 9.

Engine 5

The engine 5 is a diesel engine. Output of the engine 5 is controlled by adjusting an amount of fuel injected by a fuel injection pump (not shown). Regulation of the fuel injection rate is controlled by the control unit 9 controlling a governor provided at the fuel injection pump. Typically, an all-speed control governor is used as the governor. The engine speed and fuel injection rate are then regulated according to the load so that the actual engine speed becomes an instructed value of engine speed set by the control unit 9 (hereinafter referred to as "instructed engine speed"). Namely, the governor increases or decreases the fuel injection rate so that a difference between the instructed engine speed and the engine speed disappears.

Traveling Device 6

The traveling device 6 is a device that causes the vehicle to travel due to being driven by driving force from the engine 5. The traveling device 6 has a torque converter 60, a transmission 61, a final reduction device 62, and a sprocket wheel 63. Output of the engine 5 is transmitted to the sprocket wheel 63 via the torque converter 60, the transmission 61, and the final reduction device 62.

The torque converter 60 is coupled to an output shaft of the engine 5 via a PTO (Power Take Off) shaft 18. The torque converter 60 has a lock-up clutch LC directly coupling an input side and an output side of the torque converter 60. The lock-up clutch LC can be switched between being on and being off by hydraulic oil supplied by the traveling device hydraulic pump 19. The supply of hydraulic oil to the lock-up clutch LC is controlled by an lock-up electromagnetic valve LV controlled by a control signal from the control unit 9. Here, "on" means that the clutch is engaged, and "off" means that the clutch is disengaged.

The transmission 61 has a hydraulic forward clutch C1 and a hydraulic reverse clutch C2. It is then possible to travel forwards or in reverse by selecting one of the hydraulic forward clutch C1 or the hydraulic reverse clutch C2. The hydraulic forward clutch C1 and the hydraulic reverse clutch C2 are switched between being on and being off by hydraulic oil supplied by the traveling device hydraulic pump 19. When the hydraulic forward clutch C1 is on and the hydraulic reverse clutch C2 is off, the vehicle travels forwards. When the hydraulic forward clutch C1 is off and the hydraulic reverse clutch C2 is on, the vehicle travels in reverse. When both the hydraulic forward clutch C1 and the hydraulic reverse clutch C2 are off, a neutral state is adopted where driving force is not transmitted from the engine 5. The supply of hydraulic oil to the hydraulic forward clutch C1 is controlled by a forward solenoid valve V1. The supply of hydraulic oil to the hydraulic reverse clutch C2 is controlled by a reverse solenoid valve V2. The solenoid valves V1 and V2 are controlled by control signals from the control unit 9.

The transmission 61 also has a hydraulic first gear clutch C3, a hydraulic second gear clutch C4, and a hydraulic third gear clutch C5. It is then possible to shift gears by selecting one of the gear clutches C3 to C5. The hydraulic first gear clutch C3, the hydraulic second gear clutch C4 and the hydraulic third gear clutch C5 are actuated by hydraulic oil supplied by the traveling device hydraulic pump 19, and are switched between being on and being off. The supply of hydraulic oil to the hydraulic first gear clutch C3 is controlled by a first gear solenoid valve V3, the supply of hydraulic oil to the hydraulic second gear clutch C4 is controlled by a second gear solenoid valve V4, and the supply of hydraulic oil to the hydraulic third gear clutch C5 is controlled by a third gear solenoid valve V5. The solenoid valves V3 to V5 are controlled by control signals from the control unit 9.

Output of the engine 5 is transmitted to the sprocket wheels 63 via the torque converter 60, the transmission 61, and the final reduction device 62. The sprocket wheels 63 are therefore rotatably driven. When the sprocket wheels 63 are rotatably driven, the crawler belts 11 wound around the sprocket wheels 63 are driven (refer to FIG. 1) and the work vehicle 1 travels. Some of the horsepower of the engine 5 is therefore consumed as traveling horsepower to enable the work vehicle 1 to travel.

First Hydraulic Pump 16

The first hydraulic pump 16 is coupled to the output shaft of the engine 5 via the PTO shaft 18 and is driven by driving force of the engine 5. The first hydraulic pump 16 discharges hydraulic oil in order to drive the cooling device 7. The first hydraulic pump 16 is a variable-displacement hydraulic pump. The pump capacity is then changed by tilting an angle of a swash plate by a swash plate drive unit 21. The swash plate drive unit 21 is controlled by a control signal from the control unit 9.

Cooling Device 7

The cooling device 7 is a device driven by hydraulic oil supplied by the first hydraulic pump 16 and cools the engine 5. The cooling device 7 has a hydraulic motor 71, a cooling fan 72 rotated by the hydraulic motor 71, a radiator 73, and a hydraulic oil cooler 74.

The hydraulic motor 71 is driven by hydraulic oil supplied by the first hydraulic pump 16 and rotates the cooling fan 72. An electromagnetic switching valve 75 is provided between the hydraulic motor 71 and the first hydraulic pump 16. The electromagnetic switching valve 75 is a two-position valve that switches the direction of flow of hydraulic oil depending on an instruction signal from the control unit 9. The direction of rotation of the hydraulic motor 71, i.e. the direction of rotation of the cooling fan 72 is then controlled as a result. The speed of the hydraulic motor 71, i.e. the speed of the cooling fan 72 is controlled by controlling the pump capacity of the first hydraulic pump 16 using the swash plate drive unit 21.

The cooling fan 72 creates a flow of air that passes through the radiator 73 and the hydraulic oil cooler 74 as a result of being rotated by the hydraulic motor 71.

The radiator 73 is subjected to the air flow generated by the cooling fan 72 and cools cooling water of the engine 5.

The hydraulic oil cooler 74 is subjected to the air flow created by the cooling fan 72 similarly to the radiator 73. Hydraulic oil (hereinafter referred to as "first hydraulic oil") driving the hydraulic motor 71 of the cooling device 7 and the hydraulic cylinder 14 of the work implement 4 is then cooled by the hydraulic oil cooler 74. Hydraulic oil returning from the hydraulic motor 71 then passes through the electromagnetic switching valve 75 and enters into the hydraulic oil cooler 74. The hydraulic oil is then returned to a hydraulic oil tank 22 after being cooled by the hydraulic oil cooler 74. Although not shown in FIG. 2, hydraulic oil returning from the hydraulic cylinder 14 of the work implement 4 is also returned to the hydraulic oil tank 22 after being cooled at the hydraulic oil cooler 74. The first hydraulic oil stored in the hydraulic oil tank 22 is pressurized by the first hydraulic pump 16 and the second hydraulic pump 17 and is supplied to the hydraulic motor 71 and the hydraulic cylinder 14, respectively. The hydraulic oil cooler 74 allows hydraulic oil returning from the hydraulic clutches LV and V1 to V5 of the transmission 61 to pass. The hydraulic oil cooler therefore cools hydraulic oil driving the hydraulic clutches LV, and V1 to V5 of the transmission 61 (referred to as "second hydraulic oil" in the followings).

In the above, at the cooling device 7, when hydraulic oil is supplied to the first hydraulic motor 71, the cooling fan 72 rotates and an air flow that passes through the radiator 73 and the hydraulic oil cooler 74 is created. The cooling water of the engine 5 that flows through the radiator 73, and the first and second hydraulic oils flowing through the hydraulic oil cooler 74 are cooled as a result. Some of the horsepower of the engine 5 is therefore consumed as fan horsepower for driving the cooling device 7 cooling the cooling water of the engine 5 and the first and second hydraulic oils.

Second Hydraulic Pump 17

The second hydraulic pump 17 is coupled to the output shaft of the engine 5 via the PTO shaft 18, is driven by the engine 5, and discharges hydraulic oil to drive the hydraulic cylinder 14 of the work implement 4. The second hydraulic pump 17 is a variable-displacement hydraulic pump. The pump capacity is then changed by varying a tilt angle of a swash plate using a swash plate drive unit 29. The swash plate drive unit 29 is controlled by a control signal from the control unit 9. When the second hydraulic pump 17 is driven by driving force from the engine 5, hydraulic oil is supplied to the hydraulic cylinder 14 of the work implement 4 via an electromagnetic switching valve 23. When hydraulic oil is supplied to the hydraulic cylinder 14, the earth-moving blade 13 (refer to FIG. 1) is driven as a result of extension and contraction of the hydraulic cylinder 14. Some of the horsepower of the engine 5 is then consumed as working horsepower for driving the work implement 4.

Operation Device 8

The operation device 8 is installed within the operator's cab 15 and operation signals are sent to the control unit 9 as a result of operation by the operator. The operation device 8 has a shift switch 81, a travel lever 82 and a deceleration device 83 etc.

The shift switch 81 is for shifting gears of the transmission 61. With the work vehicle 1, it is possible to shift between first to third gears. The operator can manually shift between gears by operating the shift switch 81.

The travel lever 82 has a forward/reverse lever member 84 and a turning lever member 85. The operator can then switch the transmission 61 between forward, reverse, and neutral by operating the forward/reverse lever member 84. The operator can switch the work vehicle 1 to a turning direction by operating the turning lever member 85.

The deceleration device 83 is for reducing engine speed. When the deceleration device 83 is put on, the engine speed instructed to the engine 4 is reduced from a normal value, and when the deceleration device 83 is put off, the instructed engine speed is returned to the normal value.

Sensors SN1 to SN5

The sensors SN1 to SN5 include a first hydraulic oil temperature sensor SN1 (one example of a temperature detecting section), a cooling water temperature sensor SN2 (one example of a temperature detecting section), a second hydraulic oil temperature sensor SN3 (one example of a temperature detecting section), an engine speed sensor SN4 (one example of an engine speed detecting section), and a transmission speed sensor SN5 etc. The first hydraulic oil temperature sensor SN1 detects the temperature of the first hydraulic oil (hereinafter referred to as "first hydraulic oil temperature") driving the hydraulic motor 71 of the cooling device 7 and the hydraulic cylinder 14 of the work implement 4 by detecting the temperature of the first hydraulic oil stored in the hydraulic oil tank 22. The cooling water temperature sensor SN2 detects the temperature of cooling water of the engine 5 (hereinafter referred to as "cooling water temperature"). The second hydraulic oil temperature sensor SN3 detects the temperature of the second hydraulic oil (hereinafter referred to as second hydraulic oil temperature) in order to actuate the hydraulic clutches LV, and V1 to V5 of the traveling device 6. The engine speed sensor SN4 detects the engine speed that is the actual speed of the engine 5. The transmission speed sensor SN5 detects the vehicle speed of work vehicle 1 by detecting the speed of the output shaft of the transmission 61. The various information detected by the sensors SN1 to SN5 is inputted to the control unit 9 as detection signals.

Control Unit 9

The control unit 9 mainly includes an arithmetic processing unit such as a microcomputer or numerical arithmetic processor and has a storage unit 90 that stores control data etc. The control unit 9 performs control of the engine 5, traveling device 6, cooling device 7, and work implement 4 etc. based on operation signals from the operation device 8, detection signals from the sensors SN1 to SN5, and control data stored in the storage unit 90. For example, an engine power curve indicating a relationship between engine speed and engine torque is stored in the storage unit 90. The control unit 9 then controls the engine 5 based on the engine power curve. Further, the control unit 9 performs changing over of the lock-up clutch LC of the torque converter 60, and changing over of the hydraulic forward clutch C1, hydraulic reverse clutch C2, and shift gear hydraulic clutches C3 to C5 of the transmission 61 according to operation of the shift switch 81 and the travel lever 82 or automatically based on the vehicle speed and the engine speed.

The following is a detailed description of control of the cooling device 7 by the control unit 9.

Control of Cooling Device 7

In the work vehicle 1, the control unit 9 controls the cooling device 7 based on cooling water temperature, first hydraulic oil temperature, second hydraulic oil temperature, and engine speed. Normal cooling control and cooling suppression control exist as control of the cooling device 7 performed by the control unit 9.

Normal Cooling Control

Figure 3:
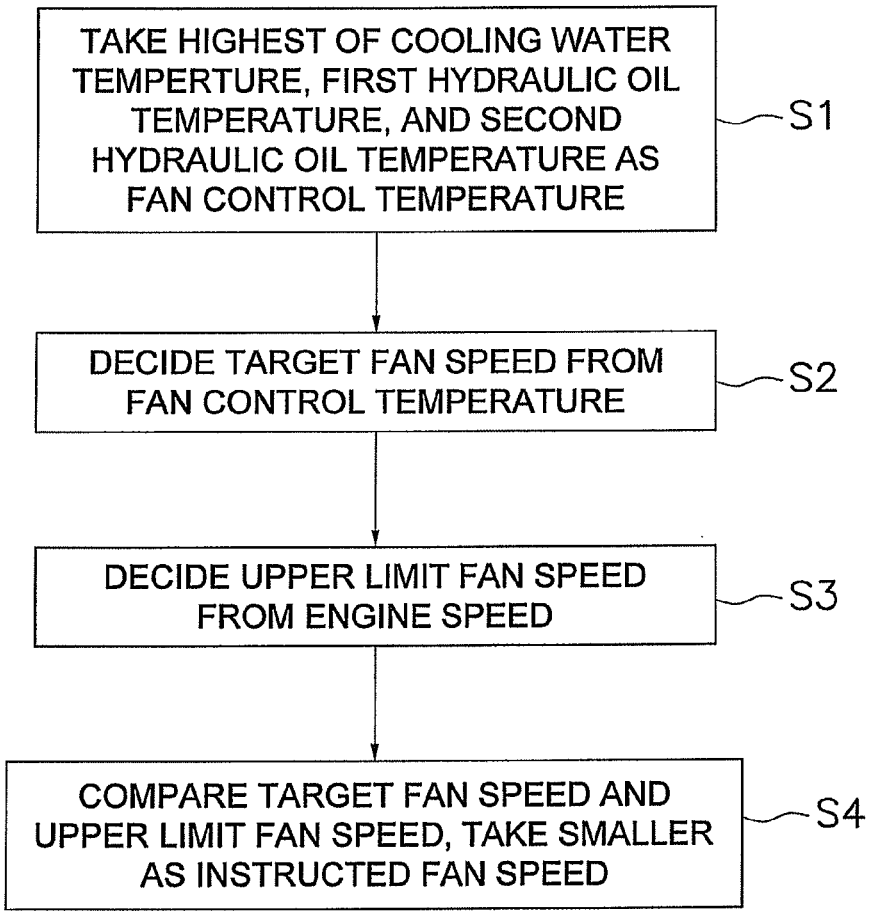
FIG. 3 is a flowchart of normal cooling control.

First, a description is given of the normal cooling control based on the flowchart shown in FIG. 3.

In step S1, the highest temperature among the cooling water temperature, the first hydraulic oil temperature, and the second hydraulic oil temperature is decided upon as the fan control temperature.

Figure 4:
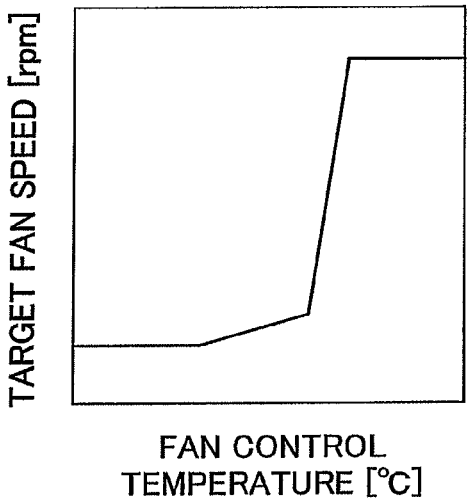
FIG. 4 is a view showing an example of target fan rotational speed data.

Next, in step S2, a target fan speed for the cooling fan 72 is decided from the fan control temperature. The target fan speed is then decided from the fan control temperature based on the target fan speed data shown in FIG. 4. The target fan speed data shows the relationship between fan control temperature and target fan speed. The target fan speed data is made in advance based on experimentation and stored in the storage unit 90.

Figure 5:
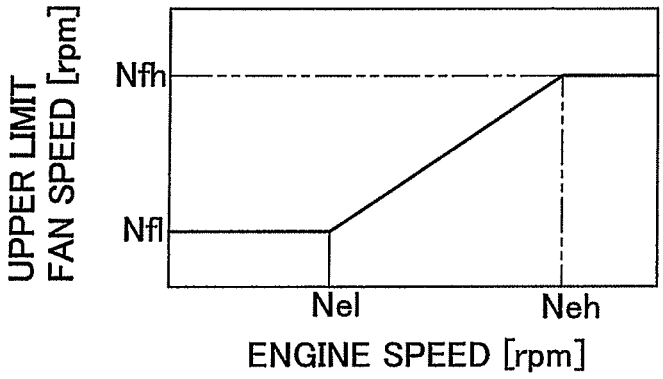
FIG. 5 is a view showing an example of upper limit fan speed data for normal cooling control.

Next, in step S3, an upper limit fan speed is decided from an engine speed. An upper limit fan speed that is an upper limit for the fan speed of the cooling fan 72 is then decided from the engine speed based on the upper limit fan speed data as shown in FIG. 5. The upper limit fan speed data shows the relationship between engine speed and upper limit fan speed. The upper limit fan speed data is made in advance based on experimentation and stored in the storage unit 90. With the upper limit fan speed data, when the engine speed is less than or equal to a low engine speed Ne1, the upper limit fan speed becomes fixed at a lower upper limit fan speed Nf1. When the engine speed is greater than or equal to a high engine speed Neh, the upper limit fan speed is fixed at an higher upper limit fan speed Nfh larger than the lower upper limit fan speed Nf1. When the engine speed is between the low engine speed Ne1 and the high engine speed Neh, the upper limit fan speed also increases according to increase in the engine speed.

Next, in step S4, the target fan speed and the upper limit fan speed are compared. The smaller rotational speed is then decided upon as an instructed fan speed. An instruction signal corresponding to the instructed fan speed is then sent from the control unit 9 to the swash plate drive unit 21. The swash plate drive unit 21 then controls the pump capacity of the first hydraulic pump 16. The hydraulic motor 71 is therefore controlled so that the cooling fan 72 is driven at the instructed fan speed.

Cooling Suppression Control

Next, a description is given of cooling suppression control. Cooling suppression control is control that suppresses the operation of the cooling device 7 to be less than normal cooling control when a predetermined operation requiring an increase in engine speed is performed.

Figure 6:
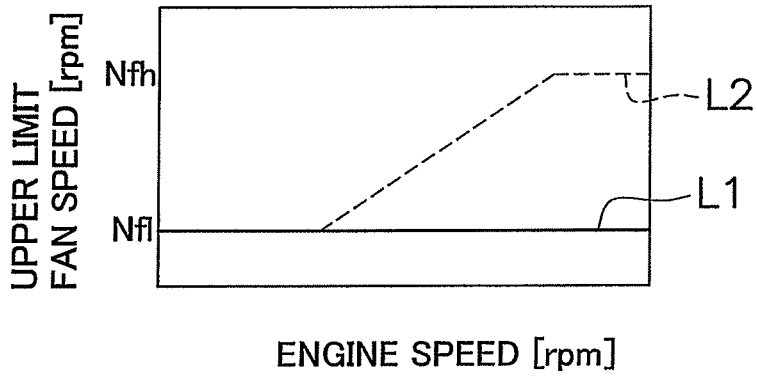
FIG. 6 is a view showing an example of upper limit fan speed data for cooling suppression control.

The instructed fan speed is decided in cooling suppression control in the same way as for normal cooling control. However, the upper limit fan speed decided in step S3 is suppressed to a value lower than the normal cooling control. For example, the upper limit fan speed data shown by the solid line L1 in FIG. 6 can be used to decide the upper limit fan speed. In FIG. 6, a dashed line L2 shows the upper limit fan speed data for the normal cooling control.

Specifically, four operations from a first mode to a fourth mode shown below exist as the predetermined operations requiring an increase in engine speed. The first mode is a case of advancing from a standstill or a case of changing between forward and reverse. The second mode is a case of switching the deceleration device 83 from on to off. The third mode is a case of switching the lock-up clutch LC from on to off. The fourth mode is a case of shifting the transmission 61 down when the work implement 4 performs a digging operation.

Figure 7:
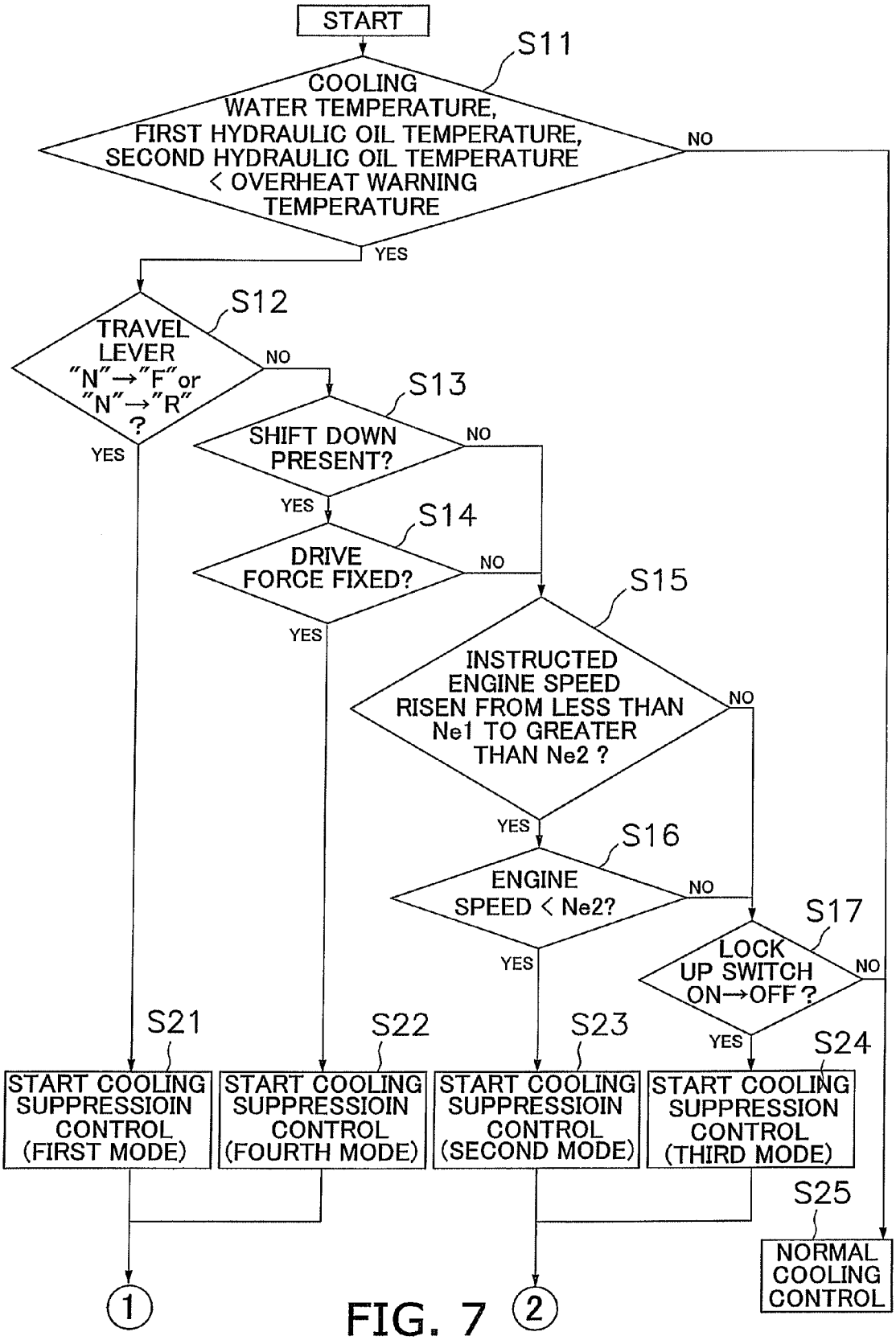
FIG. 7 is a flowchart of a start determination for cooling suppression control.

In the following, a description is given of determination of starting of the cooling suppression control and determination of ending of the cooling suppression control based on the flowcharts shown in FIGS. 7 and 8.

Determining Start of Cooling Suppression Control

First, in step S11, it is determined whether or not the cooling water temperature, the first hydraulic oil temperature, and the second hydraulic oil temperature are lower than a predetermined overheat warning temperature. The overheat warning temperature is a temperature set to prevent the occurrence of overheating at the engine 5 or the hydraulic motor 71 etc., and is obtained in advance through experimentation and stored in the storage unit 90. When at least one of the cooling water temperature, the first hydraulic oil temperature, and the second hydraulic oil temperature is in excess of the overheat warning temperature, the cooling suppression control is not started, and the normal cooling control is performed in step S25. It is therefore possible to prevent overheating of the engine 5 and the hydraulic motor 71. When the cooling water temperature, the first hydraulic oil temperature, and the second hydraulic oil temperature are all less then the overheat warning temperature, the control proceeds to step S12.

Next, in step S12, it is determined whether or not the travel lever 82 is operated to go from neutral to forward, or from neutral into reverse. When any of these operations are performed, the transmission 61 is shifted from neutral to forward or reverse. It is therefore determined that an operation of the first mode is performed, and the cooling suppression control is started in step S21. When none of the above operations is performed, the control proceeds to step S13.

In step S13, it is determined whether or not the transmission 61 is shifted down. When shifting down is performed automatically by the control unit 9 or when shifting down is performed manually as a result of the operator operating the shift switch 81, it is determined that shifting down is performed. It is then determined in a fourteenth step S14 whether or not the drive force of the work vehicle 1 is fixed (constant). At the control unit 9, the drive force of the work vehicle 1 is calculated from the engine speed, output speed of the torque converter 60, and reduction ratio of the transmission 61 and it is determined whether or not the drive force is fixed. When shifting down takes place and the drive force is fixed in step S13 and step S14, it is determined that an operation of the second mode is performed. The cooling suppression control is then started in step S22. When shifting down is not performed in step S13, or when drive force is not fixed in step S14, the control proceeds to step S15.

In step S15, it is determined whether or not instructed engine speed is increased. It is then determined whether or not the instructed engine speed is changed from less than a predetermined first speed Ne1 (refer to FIG. 10) to a second speed Ne2 larger than the first speed Ne1. In the fifteenth step S16, it is determined whether or not the engine speed is smaller than the second speed Ne2. Namely, in step S15, it is determined whether or not the deceleration device 83 changes from on to off. It is then determined in step S16 whether or not the engine speed has increased sufficiently by putting the deceleration device 83 off. In step S15 and step S16, when the instructed engine speed changes from the predetermined first speed Ne1 or less to the second speed Ne2 or more, and when the engine speed is smaller than the second speed Ne2, it is determined that a second mode operation is performed. The cooling suppression control is then started in step S23. In step S15, when the instructed engine speed is not changed from a value less than the first speed Ne1 to a value more than the second speed Ne2, or when, in step S16, the engine speed increases to the second speed Ne2 or more, the control proceeds to step S17.

In step S17, it is determined whether or not the lock-up clutch LC has gone from on to off. When the lock-up clutch LC is changed from on to off, it is determined that the third mode is being performed. The cooling suppression control is then started in step S24. When the lock-up clutch LC is not changed from on to off, the cooling suppression control is not performed and the normal cooling control is performed in step S25.

Determining End of Cooling Suppression Control

Figure 8:
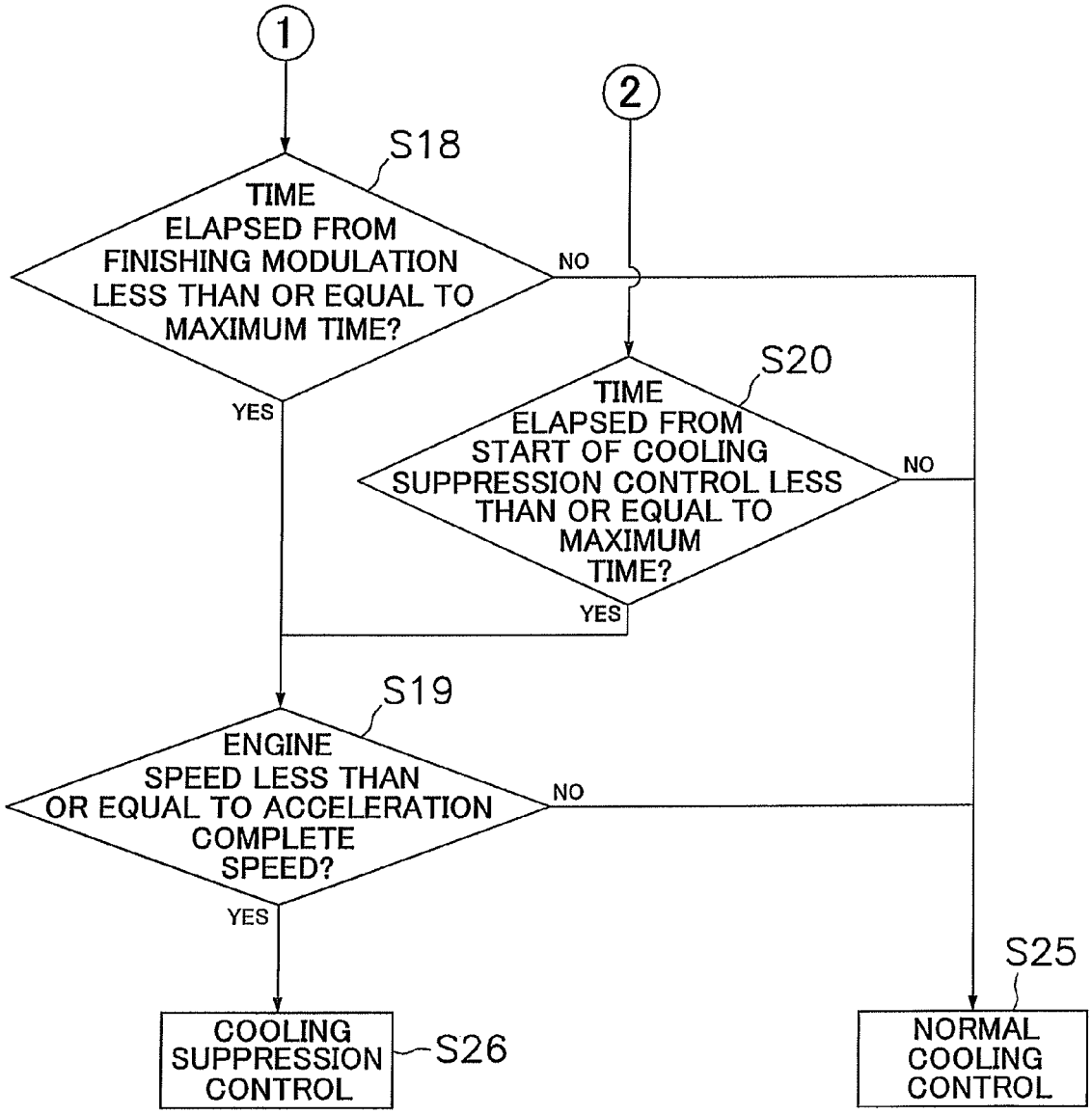
FIG. 8 is a flowchart of an end determination for cooling suppression control.

When the cooling suppression control is started by the first mode or the fourth mode of the first to fourth modes, as shown in FIG. 8, it is determined that the cooling suppression control is complete in step S18 and step S19. In step S18, it is determined whether or not a period of time that has elapsed from the reference timing is equal to or less than a predetermined maximum time taking the timing of completion of modulation of the hydraulic clutches C1 to C5 as a reference timing. The predetermined maximum time that is obtained in advance by experimentation is stored in the storage unit 90. Further, in step S19, it is determined whether or not the engine speed is an acceleration complete speed or less. The acceleration complete speed that is obtained in advance by experimentation is stored in the storage unit 90. In steps S18 and S19, when at least one of the conditions of the elapsing of the predetermined maximum time from the modulation completion time of the hydraulic clutches C1 to C5 or of the engine speed reaching the predetermined acceleration complete speed is fulfilled, the normal cooling control is returned to in step S25 and the cooling suppression control ends. When the time elapsing from the completion of modulation of the hydraulic clutches C1 to C5 is a predetermined maximum time or less and the engine speed is the predetermined acceleration complete speed or less, the cooling suppression control is continued in step S26.

When the cooling suppression control is started by the second mode or the third mode of the first to fourth modes, it is determined that the cooling suppression control is complete in step S20 and step S19. It is then determined in step S20 whether or not the time elapsed from the reference timing is equal to or less than a predetermined maximum time, taking the timing of starting the cooling suppression control as a reference timing. The above also applies for step S19. In steps S20 and S19, when at least one of the conditions of the elapsing of the predetermined maximum time from the time of starting the cooling suppression control or of the engine speed reaching the predetermined acceleration complete speed is fulfilled, normal cooling control is returned to in step S25 and the cooling suppression control ends. When the elapsed time from the time of starting the cooling suppression control is the predetermined maximum time or less and the engine speed is the predetermined acceleration complete speed or less, in step S26, the cooling suppression control continues.

Specific Example of Cooling Suppression Control

Next, a description is given of specific examples of cooling suppression control for each of the first to fourth modes.

Figure 9:
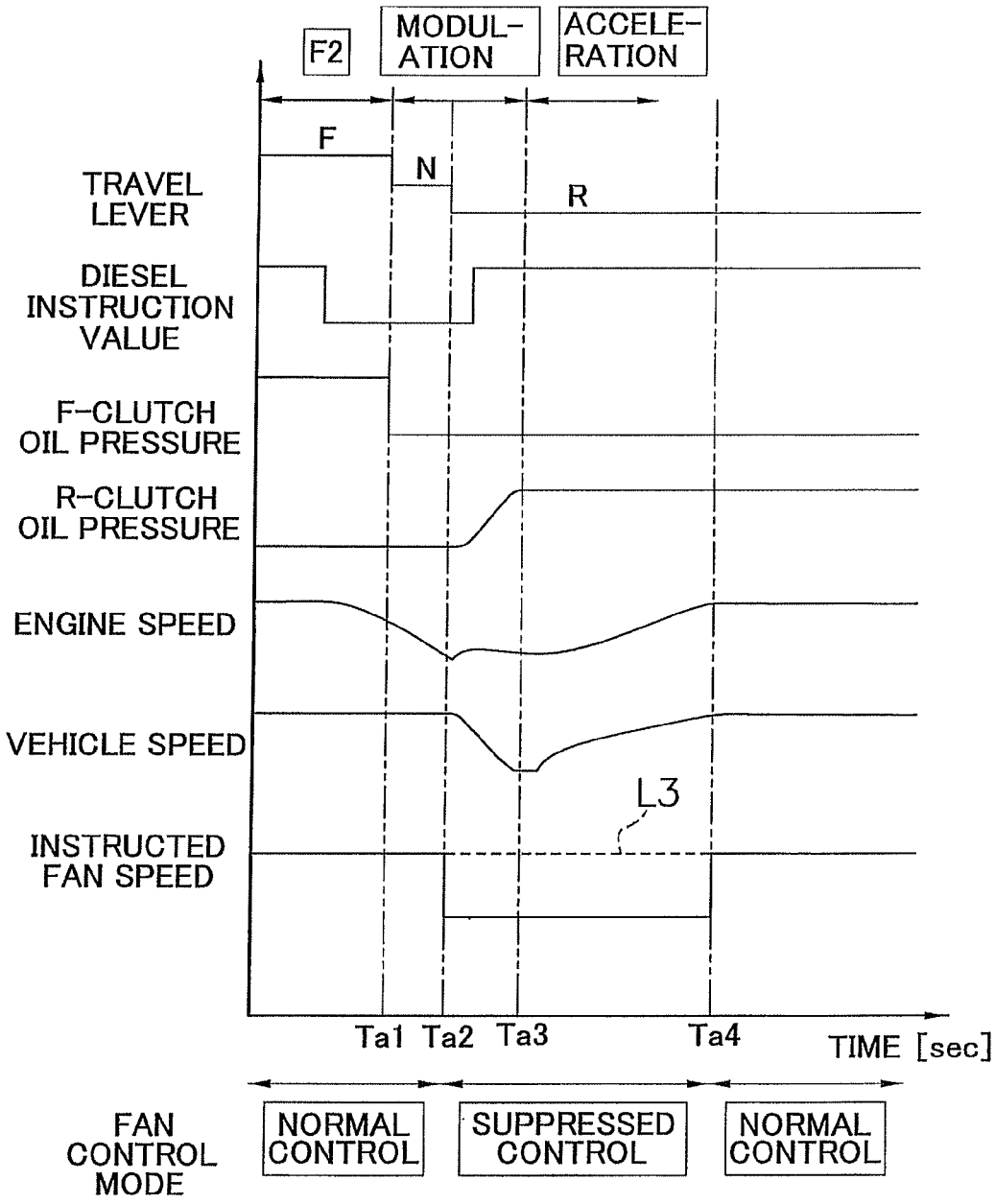
FIG. 9 is a timing chart showing an example of cooling suppression control of a first mode.

First, an example of a timing diagram for the case of cooling suppression control performed in a first mode is shown in FIG. 9. Here, the travel lever 82 is shifted from forward (F) to neutral (N) at a time Ta1, and is further shifted from neutral (N) to reverse (R) at a time Ta2. When the travel lever 82 is shifted from forward (F) to neutral (N) at the time Ta1, oil pressure of the hydraulic forward clutch C1 ("F clutch oil pressure" in the drawings) falls, with the hydraulic forward clutch C1 going off as a result. Next, when the travel lever 82 is changed from neutral (N) to reverse (R) at the time Ta2, oil pressure of the hydraulic reverse clutch C2 starts to increase from the time Ta2 and increases gradually with the passage of time, before becoming fixed at a certain time Ta3. The time Ta3 is the modulation completion time of the hydraulic reverse clutch C2. As can be understood from looking at the timing diagram for the instructed fan speed, cooling suppression control starts from the time Ta2. The instructed fan speed is then reduced to lower than the instructed fan speed (refer to the dashed line L3) for the normal cooling control. It is then possible to improve acceleration of the engine speed and the vehicle speed. The cooling suppression control ends at a time Ta4 when a predetermined maximum time elapses from a time Ta3 that is the time of modulation completion or when the engine speed reaches a predetermined acceleration complete speed.

Figure 10:
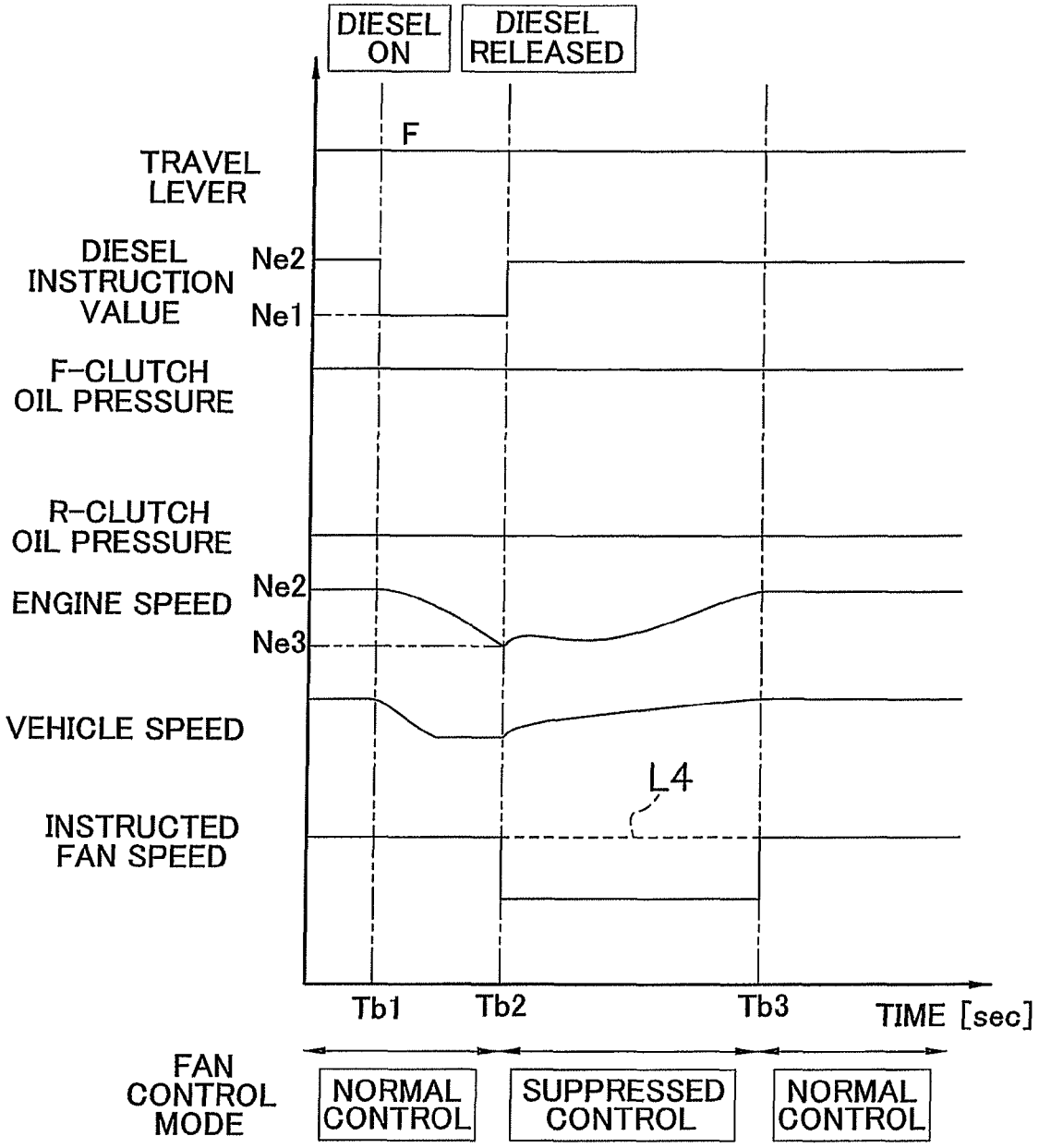
FIG. 10 is a timing chart showing an example of cooling suppression control of a second mode.

Next, an example of a timing diagram for the case of cooling suppression control performed in the second mode is shown in FIG. 10. The instructed engine speed ("instructed deceleration value" in the drawings) is then reduced from the second speed Ne2 that is a normal value to the first speed Ne1 at a time Tb1 by putting the deceleration device 83 on. The deceleration instruction value is then returned to the second speed Ne2 from the first speed Ne1 by changing the deceleration device 83 from on to off at a time Tb2. However, at time Tb2, the engine speed is the third speed Ne3 that is lower than the second speed Ne2. Cooling suppression control then starts from the time Tb2 and the instructed fan speed is slower than the instructed fan speed (refer to the dashed line L4) for during normal cooling control. It is then possible to improve acceleration of the engine speed and the vehicle speed. The cooling suppression control is ended at a time Tb3 when the predetermined maximum time elapses from the time Tb2 that is the start time of the cooling suppression control or when the engine speed reaches the predetermined acceleration complete speed.

Figure 11:
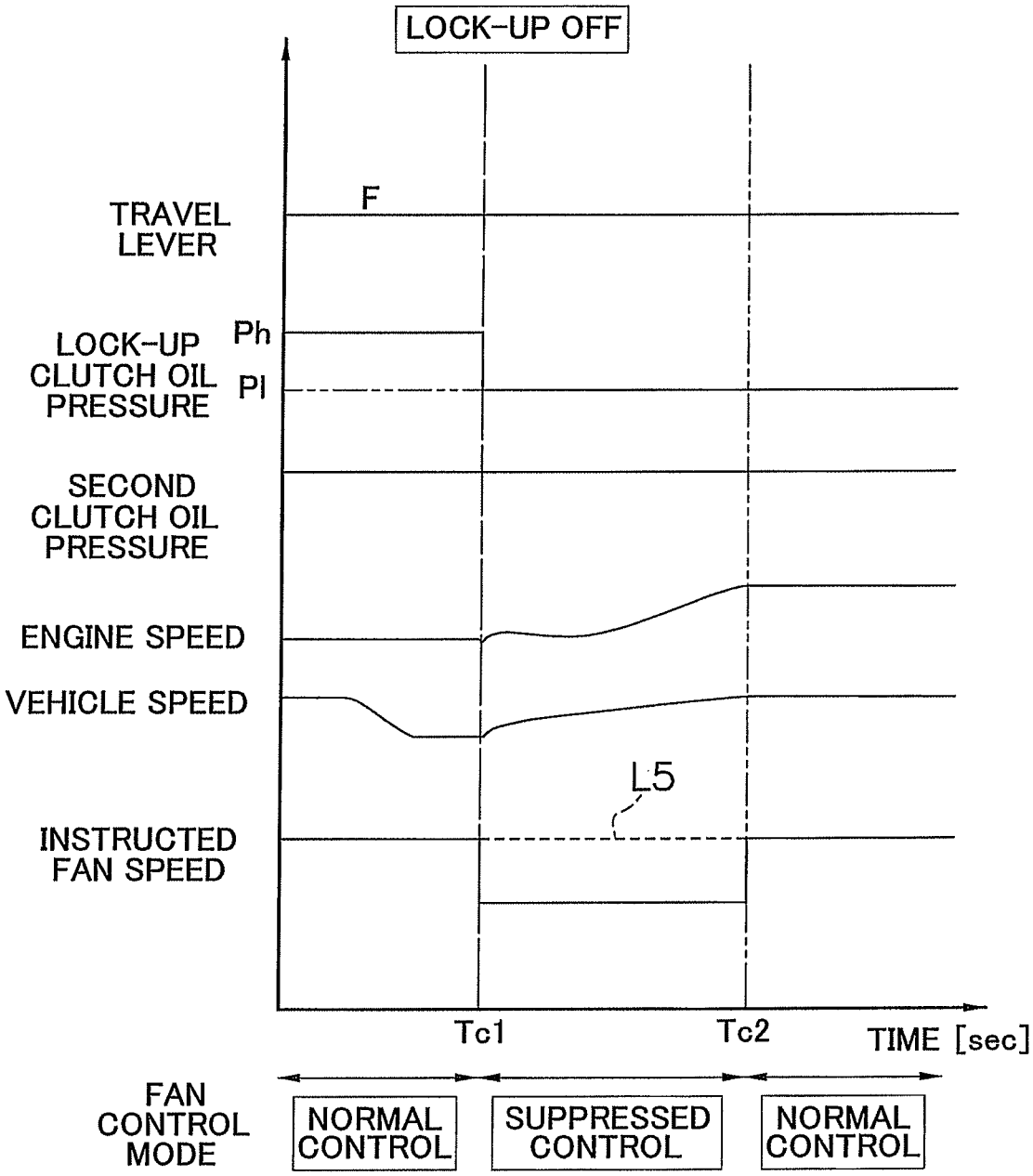
FIG. 11 is a timing chart showing an example of cooling suppression control of a third mode.

Next, an example of a timing diagram for the case of cooling suppression control performed in the third mode is shown in FIG. 11. Here, the lock-up clutch LC is switched from on to off at a time Tc1 and the oil pressure of the lock-up clutch LC is decreased from Ph to P1. In this case, the cooling suppression control is started from the time Tc1. The instructed fan speed is reduced to lower than the instructed fan speed during normal cooling control (refer to the dashed line L5). It is then possible to improve acceleration of the engine speed and the vehicle speed. The cooling suppression control is ended at a time Tc2 when a predetermined maximum time elapses from the time Tc1 that is the start time of the cooling suppression control or when the engine speed reaches the predetermined acceleration complete speed.

Figure 12:
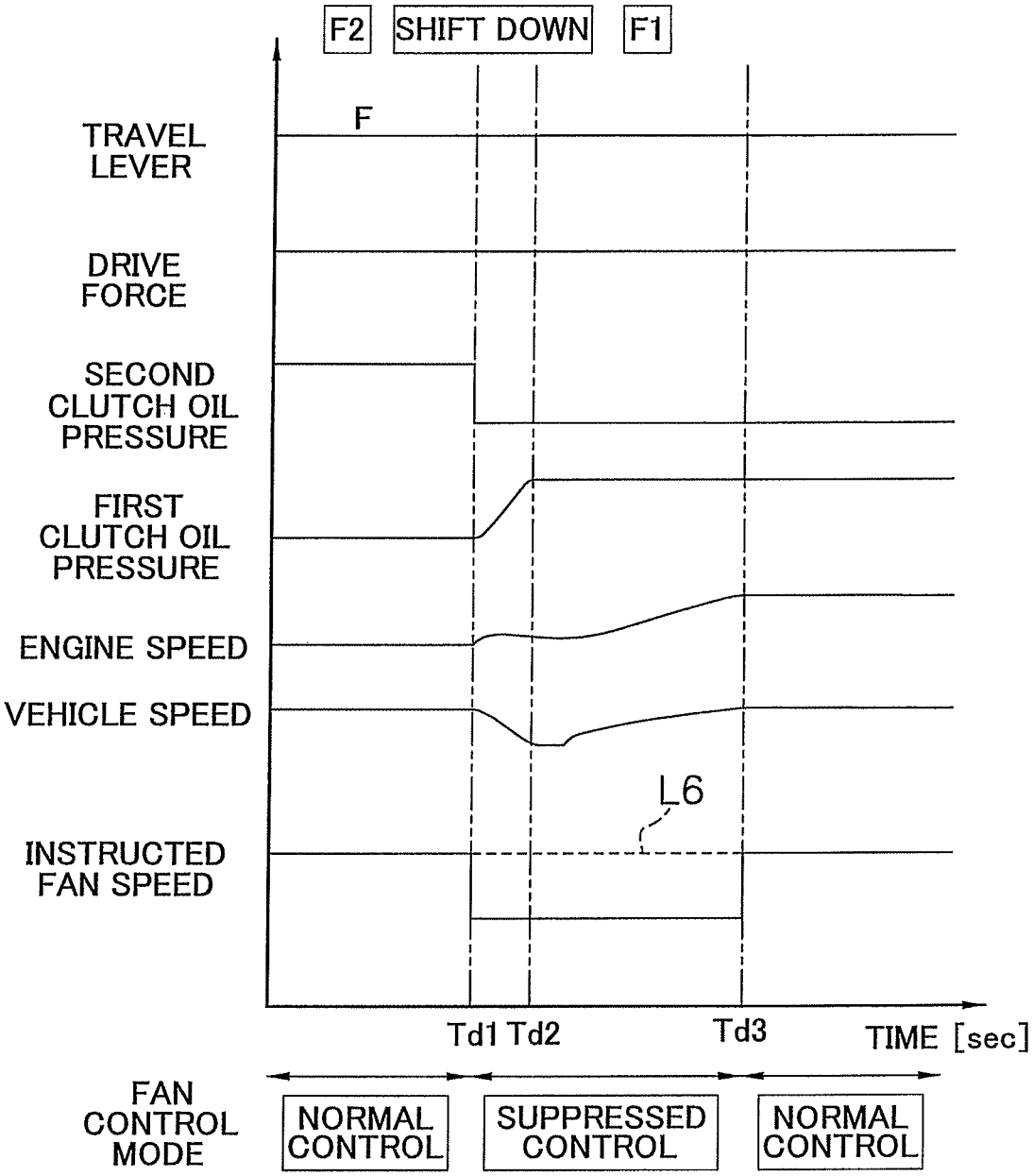
FIG. 12 is a timing chart showing an example of cooling suppression control of a fourth mode.

Next, an example of a timing diagram for the case of cooling suppression control performed in the fourth mode is shown in FIG. 12. At a time Td1, the first gear is shifted down to from the second gear either as a result of operation of the shift switch 81 or automatically by the control unit 9. The oil pressure of the hydraulic second gear clutch C4 ("second clutch oil pressure" in the drawings) is then decreased and the hydraulic second gear clutch C4 is put off. Further, increasing of the oil pressure ("first clutch oil pressure" in the drawings) of the hydraulic first gear clutch C3 is started from a time Td1, and is gradually increased with the passage of time. The first clutch oil pressure then becomes fixed at a certain time Td2. The time Td2 is the modulation completion time for the hydraulic first gear clutch C3. As can be understood from looking at the timing diagram for the instructed fan speed, the cooling suppression control starts from the time Td1. The instructed fan speed is then reduced to lower than the instructed fan speed (refer to the dashed line L6) for the normal cooling control. It is then possible to improve acceleration of the engine speed and the vehicle speed. The cooling suppression control ends at a time Td3 when a predetermined maximum time elapses from the time Td2 that is the time of modulation completion or when the engine speed reaches a predetermined acceleration complete speed.

At the work vehicle 1, cooling suppression control is performed to suppress operation of the cooling device 7 when the first mode to the fourth mode deemed necessary to increase the engine speed are performed. As a result, it is possible to reduce the fan horsepower in order to drive the cooling device 7. It is then possible to increase the traveling horsepower for making the work vehicle 1 travel and it is possible to increase acceleration for the engine speed and the vehicle speed.

Further, the cooling suppression control ends when at least one condition of the engine speed reaching a predetermined speed, and a predetermined time elapsing from a predetermined reference timing is satisfied. It is therefore possible to prevent a situation where suppression of operation of the cooling device 7 continues for a long period of time and it is possible to suppress excessive falls in cooling performance of the engine 5.

The reference timing that is a starting point of the elapsed time used in the determination of completion of the cooling suppression control is the timing of completion of modulation of the hydraulic clutches C1 to C5 during implementation of the cooling suppression control in the first mode and the fourth mode. The reference timing is then the timing of starting cooling suppression control during implementation of the cooling suppression control in the second mode and the third mode. Namely, the reference timing differs depending on the cooling suppression control starting conditions. It is therefore possible to end the cooling suppression control at appropriate timings in each mode.

Other Embodiments (a) In the above embodiment, control of the cooling fan 72 is performed by controlling the discharge amount of the first hydraulic pump 16 that is a variable-displacement hydraulic pump and drives the hydraulic motor 71. However, the present invention is by no means limited in this respect, and, for example, control of the capacity of the hydraulic motor 71 using a fixed-displacement hydraulic pump and a variable-displacement hydraulic motor is possible.

(b) In the above embodiment, implementation of the second mode is determined using change in the instructed engine speed. However, it is also possible to provide a sensor that outputs a signal indicating whether the deceleration device 83 is on or off to the control unit 9 and determine implementation of the second mode based on an output signal from the sensor. In this case, when an output signal indicating that the deceleration device 83 has changed from on to off is detected and the engine speed is lower than the normal value, the cooling suppression control can be performed.

(c) In the above embodiment, the upper limit fan speed data for during the cooling suppression control can also have a different characteristic for each of the first to fourth modes.

(d) In the above embodiment, a bulldozer is cited as a work vehicle 1 but the present invention can also be applied to other work vehicles.

(e) In the above embodiments, an example is shown of four operations from a first mode to a fourth mode as predetermined operations for the work vehicle 1 where the cooling suppression control is performed. However, the operations of the work vehicle 1 where the cooling suppression control is performed is by no means limited, and the cooling suppression control can also be performed when other operations are performed.

The work vehicle and the control method for the work vehicle as described above are therefore useful as a work vehicle and a control method for the work vehicle that promote increase in engine speed and suppress excessive falls in cooling performance of an engine.

The invention claimed is:

1. A work vehicle comprising:

an engine;

a traveling device configured and arranged to be driven by driving force from the engine to cause the work vehicle to travel;

a first hydraulic pump configured and arranged to be driven by the driving force from the engine to discharge hydraulic oil;

a cooling device including a cooling fan configured and arranged to be driven by the hydraulic oil supplied by the first hydraulic pump to cool the engine;

a plurality of temperature detecting sections configured and arranged to detect at least a temperature of a cooling water of the engine and a temperature of a hydraulic oil of the first hydraulic pump;

an engine speed detecting section configured and arranged to detect an actual engine speed of the engine, and a control unit programmed to selectively perform a normal cooling control or a cooling suppression control to control a speed of the cooling fan, the normal cooling control being configured to control the speed of the cooling fan to the smaller of a target fan speed and a first upper limit fan speed, the target fan speed being determined based on at least one of the temperatures detected by the temperature detecting sections, and the first upper limit fan speed being determined based on a first upper limit fan speed data that indicates a relationship between the first upper limit fan speed and the actual engine speed, and the cooling suppression control being configured to control the speed of the cooling fan to the smaller of the target fan speed and a second upper limit fan speed, the second upper limit fan speed being determined based on a second upper limit fan speed data that is different from the first upper limit fan speed data and indicates a relationship between the second upper limit fan speed and the actual engine speed so that the second upper limit fan speed is smaller than the first upper limit fan speed if the actual engine speed is in a high actual engine speed region and equal to the first upper limit fan speed if the actual engine speed is in a low actual engine speed region, the first and second upper limit fan speed data being stored in advance, and the control unit being programmed to perform the cooling suppression control when an engine speed instruction value changes from a predetermined first speed or less to a value greater than or equal to a second speed faster than the first speed while the actual engine speed is smaller than the second speed.

2. The work vehicle according to claim 1, wherein the control unit is programmed to end the cooling suppression control when at least one of a condition in which the actual engine speed reaches a predetermined speed and a condition in which a predetermined time elapses from a predetermined reference timing set on or after a start timing of the cooling suppression control is satisfied.

3. The work vehicle according to claim 1, wherein the traveling device has a transmission configured and arranged to shift between neutral, forward, and reverse modes, and the control unit is further programmed to perform the cooling suppression control when the transmission is put into the forward or reverse mode from the neutral mode.

4. The work vehicle according to claim 1, wherein the traveling device has a transmission configured and arranged to shift between a plurality of gear positions, and the control unit is further programmed to calculate drive force of the work vehicle and to perform the cooling suppression control when the drive force is constant and the transmission shifts down.

5. The work vehicle according to claim 2, wherein the traveling device has a transmission configured and arranged to shift between neutral, forward and reverse modes, the transmission has a clutch configured and arranged to be driven by hydraulic oil, the control unit is further programmed to perform the cooling suppression control when the transmission is shifted from the neutral mode to the forward or reverse mode, and the reference timing is a modulation ending timing of the clutch.

6. The work vehicle according to claim 1, wherein the traveling device has a torque converter with a lock-up clutch, and the control unit is further programmed to perform the cooling suppression control when the lock-up clutch changes from on to off.

7. The work vehicle according to claim 1, further comprising a decelerator device configured and arranged to reduce the engine speed instruction value from a normal value when the decelerator device is changed to on state, and to increase the engine speed instruction value back to the normal value when the decelerator device is changed to off state, the control unit being further programmed to perform the cooling suppression control when the decelerator device is changed from the on state to the off state and the actual engine speed is smaller than a speed corresponding to the normal value.

8. The work vehicle according to claim 2, wherein the traveling device has a torque converter with a lock-up clutch, the control unit is further programmed to perform the cooling suppression control when the lock-up clutch changes from on to off, and the reference timing is the start timing of the cooling suppression control.

9. A work vehicle comprising:

an engine;

a first hydraulic pump configured and arranged to be driven by the driving force from the engine to discharge hydraulic oil;

a second hydraulic pump configured and arranged be driven by the engine to discharge hydraulic oil;

a work implement configured and arranged to be driven by the hydraulic oil supplied by the second hydraulic pump;

a traveling device configured and arranged to be driven by driving force from the engine to cause the work vehicle to travel, the traveling device having a transmission configured and arranged to switch gears by changing over engagement of a clutch using hydraulic oil;

a cooling device including a cooling fan and a hydraulic motor, the hydraulic motor being configured and arranged to be driven by hydraulic oil supplied by the first hydraulic pump to rotate the cooling fan, the cooling device being configured and arranged to cool cooling water of the engine, the hydraulic oil supplied to the work implement and the hydraulic motor, and the hydraulic oil supplied to the clutch;

a plurality of temperature detecting sections configured and arranged to detect at least a temperature of a cooling water of the engine and a temperature of a hydraulic oil of the first hydraulic pump;

an engine speed detecting section configured and arranged to detect an actual engine speed of the engine, and a control unit programmed to selectively perform a normal cooling control or a cooling suppression control to control a speed of the cooling fan, the normal cooling control being configured to control the speed of the cooling fan to the smaller of a target fan speed and a first upper limit fan speed, the target fan speed being determined based on at least one of the temperatures detected by the temperature detecting sections, and the first upper limit fan speed being determined based on a first upper limit fan speed data that indicates a relationship between the first upper limit fan speed and the actual engine speed, and the cooling suppression control being configured to control the speed of the cooling fan to the smaller of the target fan speed and a second upper limit fan speed, the second upper limit fan speed being determined based on a second upper limit fan speed data that is different from the first upper limit fan speed data and indicates a relationship between the second upper limit fan speed and the actual engine speed so that the second upper limit fan speed is smaller than the first upper limit fan speed if the actual engine speed is in a high actual engine speed region and equal to the first upper limit fan speed if the actual engine speed is in a low actual engine speed region, the first and second upper limit fan speed data being stored in advance, and the control unit being programmed to perform the cooling suppression control when a predetermined operation required to increase an engine speed is performed, and the control unit being programmed to prohibit the cooling suppression control when at least one of a temperature of the engine cooling water, a temperature of the hydraulic oil supplied to the work implement and the hydraulic motor, and a temperature of the hydraulic oil supplied to the clutch is equal to or greater than a predetermined overheat warning temperature.

10. A work vehicle according to claim 1, further comprising a decelerator device configured and arranged to reduce an instruction value of the engine speed from a normal value when the decelerator device is changed to on state, and to increase the instruction value of the engine speed back to the normal value when the decelerator device is changed to off state;

the traveling device having a transmission configured and arranged to shift between neutral, forward and reverse modes and to change between a plurality of gear positions, and a torque converter with a lock-up clutch, and the control unit being programmed to perform the cooling suppression control when one of a first mode, a second mode, a third mode, and a fourth mode is performed, the first mode being a case of advancing from a standstill or shifting between the forward and reverse modes, the second mode being a case of switching the deceleration device from on to off, the third mode being a case of switching the lockup clutch from on to off, and the fourth mode being a case of shifting the transmission down when drive force of the work vehicle is constant.

11. The work vehicle according to claim 2, wherein the traveling device has a transmission configured and arranged to shift between a plurality of gear positions, the transmission has a clutch driven by hydraulic oil, the control unit is programmed to calculate drive force of the work vehicle and to perform the cooling suppression control when the drive force is constant and the transmission shifts down, and the reference timing is a modulation ending timing of the clutch.

12. The work vehicle according to claim 2, wherein the reference timing is the start timing of the cooling suppression control.

13. A control method for a work vehicle equipped with an engine, a traveling device driven by driving force from the engine to cause the work vehicle to travel, a first hydraulic pump driven by the driving force from the engine to discharge hydraulic oil, a cooling device having a cooling fan driven by the hydraulic oil supplied by the first hydraulic pump to cool the engine, a plurality of temperature detecting sections configured and arranged to detect at least a temperature of a cooling water of the engine and a temperature of a hydraulic oil of the first hydraulic pump, an engine speed detecting section configured and arranged to detect an actual engine speed of the engine, the control method comprising:

determining whether a predetermined operation requiring an increase in engine speed is being performed or not;

performing a normal cooling control if the predetermined operation is not being performed; and performing a cooling suppression control if the predetermined operation is being performed, the normal cooling control being configured to control the speed of the cooling fan to the smaller of a target fan speed and a first upper limit fan speed, the target fan speed being determined based on at least one of the temperatures detected by the temperature detecting sections, and the first upper limit fan speed being determined based on a first upper limit fan speed data that indicates a relationship between the first upper limit fan speed and the actual engine speed, the cooling suppression control being configured to control the speed of the cooling fan to the smaller of the target fan speed and a second upper limit fan speed, the second upper limit fan speed being determined based on a second upper limit fan speed data that is different from the first upper limit fan speed data and indicates a relationship between the second upper limit fan speed and the actual engine speed so that the second upper limit fan speed is smaller than the first upper limit fan speed if the actual engine speed is in a high actual engine speed region and equal to the first upper limit fan speed if the actual engine speed is in a low actual engine speed region, the predetermined operation including at least an operation that causes an instruction value of the engine speed to change from a predetermined first speed or less to a value greater than or equal to a second speed faster than the first speed, while the actual engine speed is smaller than the second speed.

14. The work vehicle according to claim 1, wherein the second upper limit fan speed data indicate that the second upper limit fan speed is a fixed value with respect to the actual engine speed.

15. The work vehicle according to claim 9, wherein the second upper limit fan speed data indicate that the second upper limit fan speed is a fixed value with respect to the actual engine speed.

16. The control method for a work vehicle according to claim 13, wherein the second upper limit fan speed data indicate that the second upper limit fan speed is a fixed value with respect to the actual engine speed.

* * * * *